US005599025A

United States Patent [19]

Pobee-Mensah

[11] Patent Number: 5,599,025

[45] Date of Patent: Feb. 4, 1997

[54] METHODS AND APPARATUS FOR PLAYING A BALL GAME

[76] Inventor: Anthony Pobee-Mensah, 180 Morris St., Albany, N.Y. 12208

[21] Appl. No.: 631,409

[22] Filed: Apr. 12, 1996

[51] Int. Cl.[6] ..... A63B 71/02

[52] U.S. Cl. ..... 473/471

[58] Field of Search ..... 273/411, 400, 273/398, 127 R, 127 B, 123 R; 472/92, 94, 136, 137

[56] References Cited

U.S. PATENT DOCUMENTS 4,497,483 2/1985 Ahlgren ..... 473/94 X
5,312,109 5/1994 Cagle ..... 273/411

*Primary Examiner*—William H. Grieb
*Attorney, Agent, or Firm*—Heslin & Rothenberg, P.C.

[57] ABSTRACT

A method of playing a ball game is disclosed wherein two opposed teams play within an enclosed area in which the width is greater than the length; a goal is scored by placing the ball into a recessed area behind the goal line. An offensive player may not stay within a two second box located about the goal mouth and any player engaging in rough play shall sit out for a designated time period and his or her team shall play a man down during that time.

27 Claims, 4 Drawing Sheets

METHODS AND APPARATUS FOR PLAYING A BALL GAME

FIELD OF INVENTION

The present invention relates to methods and apparatus for playing a ball game.

BACKGROUND OF THE INVENTION

Soccer, referred to as "football" in the majority of other countries, is one of the most popular sports in the world, both at professional and amateur levels. In this regard, for many countries soccer is considered the national sport. Even in the United States soccer has recently made considerable strides in popularity. Thus, there exists a continuous need for improved methods and apparatus for teaching soccer skills to developing players.

In developing the skills of younger players, as well as honing the skills of veteran players, it is desirous to teach the player a variety of individual skills; examples being dribbling, passing and trapping. However, often overlooked, and more difficult to teach developing players, is an appreciation of how to work one's individual skills into a fluid game with other team members. In order to increase a player's ability to .act as part of a team a greater understanding of the game, beyond ones individual skills, must be developed. Examples of the concepts young players need to appreciate is an understanding of team defense, passing lanes, one touch passing, and proper off-the-ball movement. For without an understanding of how to properly work individual skills into a fluid team game, such as soccer, neither the individual nor the team can succeed.

Due to the number of players, field size and the typical ball movement in a traditional soccer game, it is often difficult to focus on and develop individual skills as well as an understanding of other aspects of the game. In this regard numerous drills and tactics have been developed by various coaches and trainers in order to help players develop particular individual skills. However, new methods and ball games which focus on the development of one's individual skills and yet which also help players focus on and come to appreciate fundamental aspects of the game itself, such as movement away from the ball and team defense, are in great need.

SUMMARY OF THE INVENTION

The aforesaid needs are fulfilled by a ball game apparatus comprising a playing area, located on a surface, substantially defined by two side lines and two end lines, with the end lines being longer than the side lines. The game apparatus further comprises at least one goal having a recess of sufficient size to accept a ball and disposed to allow a ball to roll from said playing area and drop therein. Preferably the apparatus has two goals, with each goal located midway between the two side lines and with the recess outside the end lines. In a further aspect, the playing area may be marked by a line extending from the mid-point of one side line to the mid-point of the opposite side line and a line extending from the mid-point of one end line to the mid-point of the opposite end line. The playing area may also have a zone defined thereon about said goal line. The goal may also be defined by a first and second supports with a barrier extending substantially horizontally there between. The ball game may further have a wall extending along the length of the side lines and end lines.

In a further aspect, the aforesaid needs may be fulfilled by an apparatus for a ball game, comprising: first and second supports defining a line there between; a barrier extending between said supports wherein the barrier does not extend lower than 36 inches above the line; and a recess with an opening extending parallel to said line and disposed to allow a ball to roll over said line and drop therein. At least a lower portion of the barrier may be padded for player safety and the recess opening may be in the same plane as the line.

In a further aspect, the aforesaid needs may be fulfilled by a method of playing a ball game on a playing area between a first and second team wherein said first team defends a first goal and said second team defends a second goal, comprising: placing a ball in play on the playing area; kicking the ball within a recess disposed to allow a ball to roll from the playing area and drop into the recess thereby scoring a goal; and tallying scores wherein the team with the greatest number of goals at the end of a desired playing period wins the game. In playing the aforesaid ball game, when the ball goes out of bounds over a side line, the team who was not the last to contact the ball prior to its leaving the playing area may be awarded a throw-in at the point the ball exits the playing area. When a throw-in is awarded, at least two of the players of the team not taking the throw-in may be required to be in the quarter of the field furthest from where the throw-in is taken prior to throwing the ball back into play. In the game it may also be a foul to engage in rough play and a player who engages in such play may be required to leave the game for a selected length of time during which the infringing player's team shall play short handed. In addition, a ball going out of bounds over an end line may result in a goal kick for the team defending that end regardless of which player was the last to touch the ball prior to its leaving the playing area. In the present game a penalty may be incurred by a team whose player is within a designated area near a goal for a defined period of time. In addition, in the aforesaid game a penalty may be assessed when a player reaches over a goal line after the ball has crossed the goal line or in an attempt to prevent a goal.

DESCRIPTION OF THE PREFERRED EMBODIMENT

Figure 1:
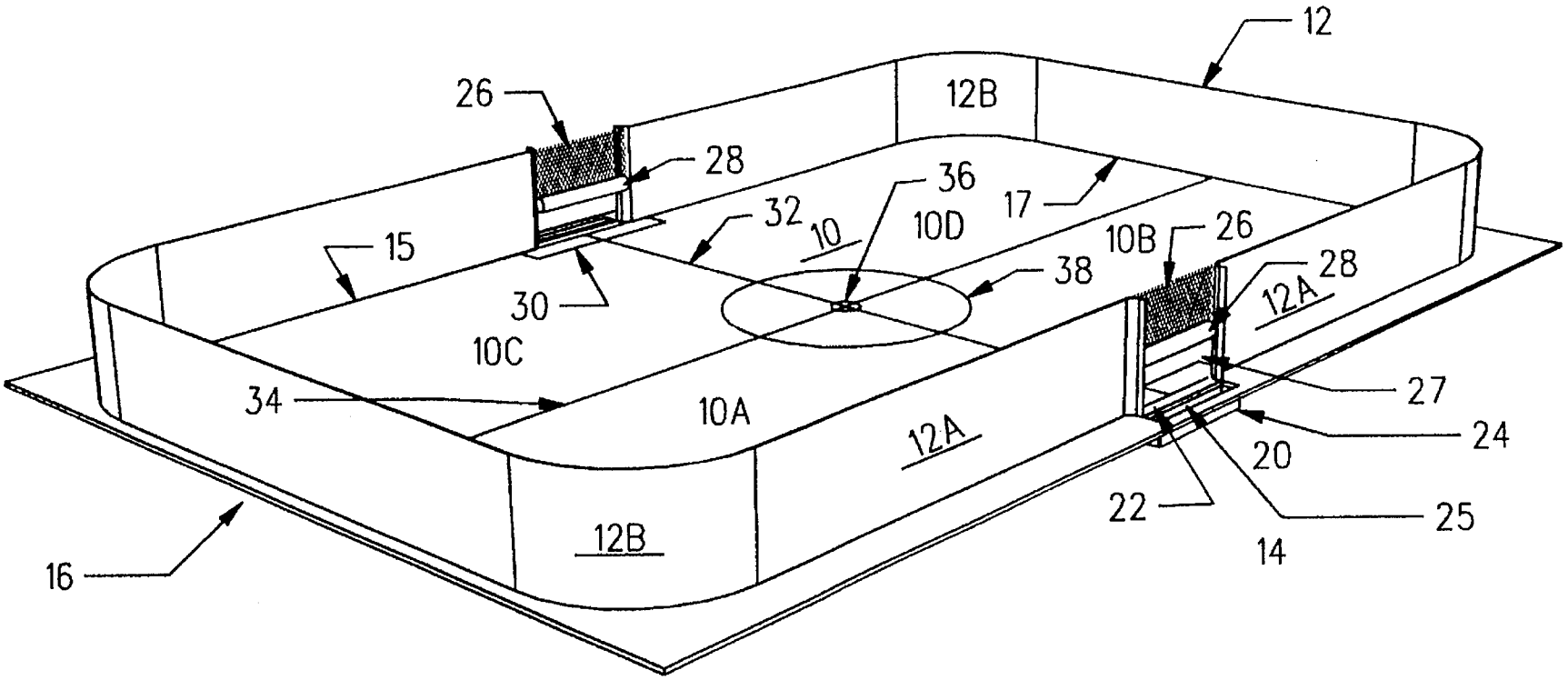
FIG. 1 is a partially elevated view of a playing field of the present invention.

A ball game designed to teach and emphasize team defense, controlled passing, trapping, off-the-ball movement and other important soccer skills may be seen in reference to FIG. 1. Such a ball game may comprise a playing field 10, defined by a wall 12, in which the width 14 is greater than its length 16. Each of the goals 20, positioned along an end line 15, have a recess 24 adjacent the goal line 22 and opposite the playing field 10. The goals may further have a barrier 26 positioned above the goal line 22 that extends between walls 12A defining the goal length.

Figure 2:
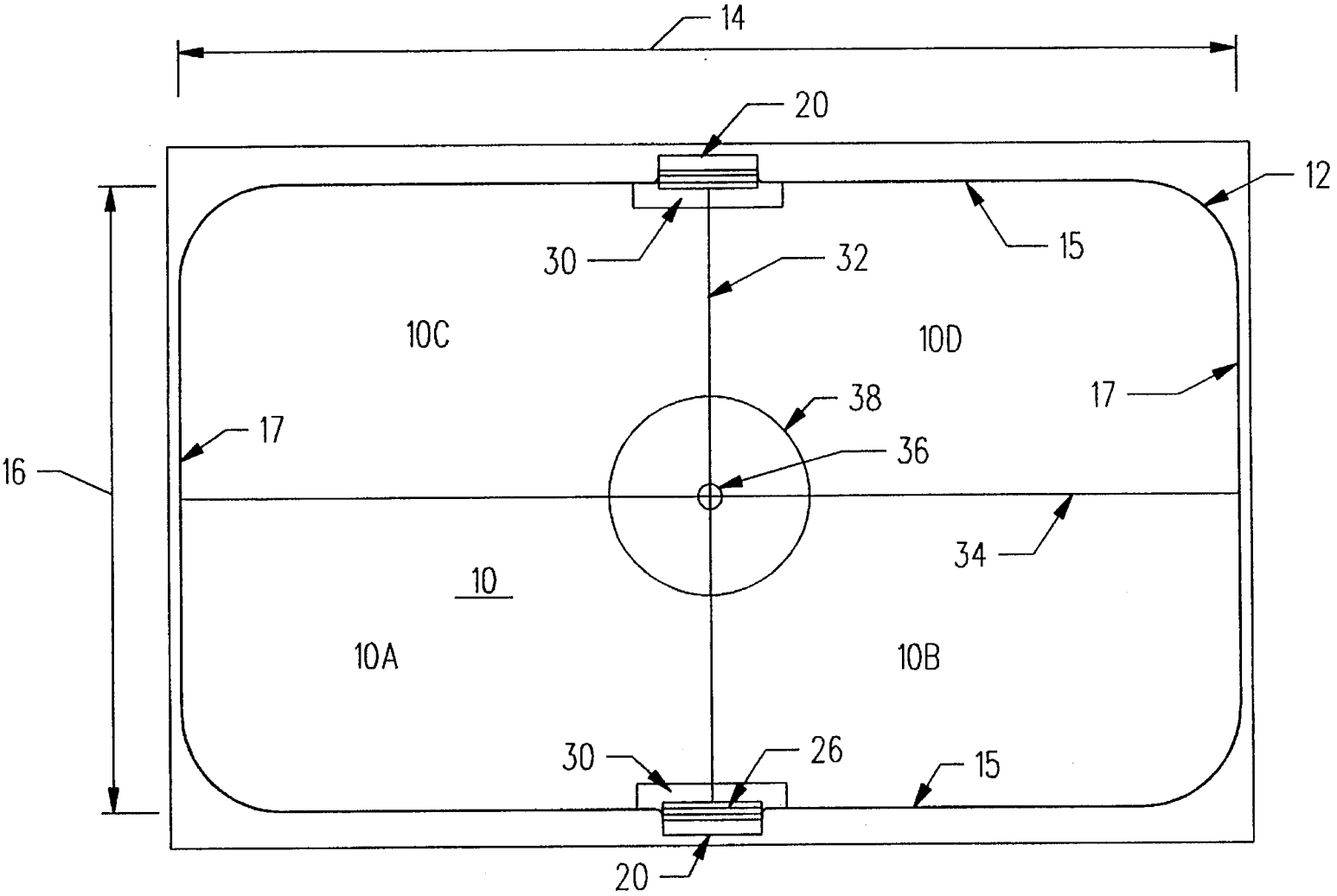
FIG. 2 is a top view of the playing field of the present invention.

As shown in FIGS. 1 and 2, the floor or playing area 10 has a width 14 greater than its length 16. In a preferred embodiment, the field may comprise a fifty foot by eightyfour foot field. Preferably, the end lines 15 and side lines 17 defining the playing area are defined by a wall 12. In the preferred embodiment the wall 12 is made of a clear material, such as a plexiglass, having a height of from 6 to 7 feet. It is further preferred that the corner panels 12B of the wall 12 be rounded; when using a 50'×84' playing area, the rounded corners 12B may have a radius of 8 feet. The walls 12 may comprise a continuous frame or numerous contiguous panels. As shown in FIGS. 1 and 2, a portion of the wall 12A along the end line 15 may be omitted to define the length of the goal 20.

As shown in FIGS. 1–4, a goal line 22 is located along each of the end lines 15. The goal 20 comprises a recess 24 having a length and width which allows the ball to fall down into the recess 24. Preferably, the goal 20 is centered about the mid-point of the end line 15. In using the 50'×84' playing area the goal may have a length of 8 feet. The goal 20 may be positioned adjacent the end line 15 such that the goal line 22 separates the playing area 10 and the recess 24. Thus, the recess 24 acts as a means for disallowing a shot having excessive speed or that is poorly made, i.e. a bouncing or a deflected shot. In regard to the preferred embodiment, the goal 20 may comprise a recess 24 which is parallel to and is positioned one foot behind the goal line 22 having the following dimensions 8' L×14" W×14" H. In the particular embodiment shown in FIGS. 3 and 4, the top of the recess 24 is level with the playing field 10 and the depth of the recess 24 is measured from the surface of the playing area 10 downward. On some surfaces it may not be possible to provide a recess below the playing field level, such as in an indoor venue. In such cases the playing field may comprise an elevated floor with the recess extending therebelow. However, the recess need not always be positioned lower than the playing area. The bottom portion of the recess could be parallel to the playing field such that the open portion of the recess is above the playing field, ramps could lead from the goal line to the opening of the recess.

Extending above the goal line 22, between the two walls 12A which define the length of the goal 20, may be a barrier 26 positioned at a height above the playing area 10 that allows the ball to pass thereunder. Thus, the goal line 22, walls 12A and barrier 26 may form a goal mouth 27. Preferably the barrier 26 is positioned a height sufficient to assure player safety. The barrier 26 may be positioned at a height of 36" above the goal line 22 and may extend from its lowest point above the goal line 22 to the top of the walls 12A. An example of such a barrier may include a net 2.5 spanning two opposed wall panels 12A defining the goal. In addition, a protective rope 28 may be used in conjunction with the net 26. Preferably, the protective rope 28 defines the lower end of the net 26 and comprises a 1 to 1.5 inch diameter rope with a foam padding sleeve thereover. The barrier could alternatively comprise a wall having a lower portion removed.

Figure 3:
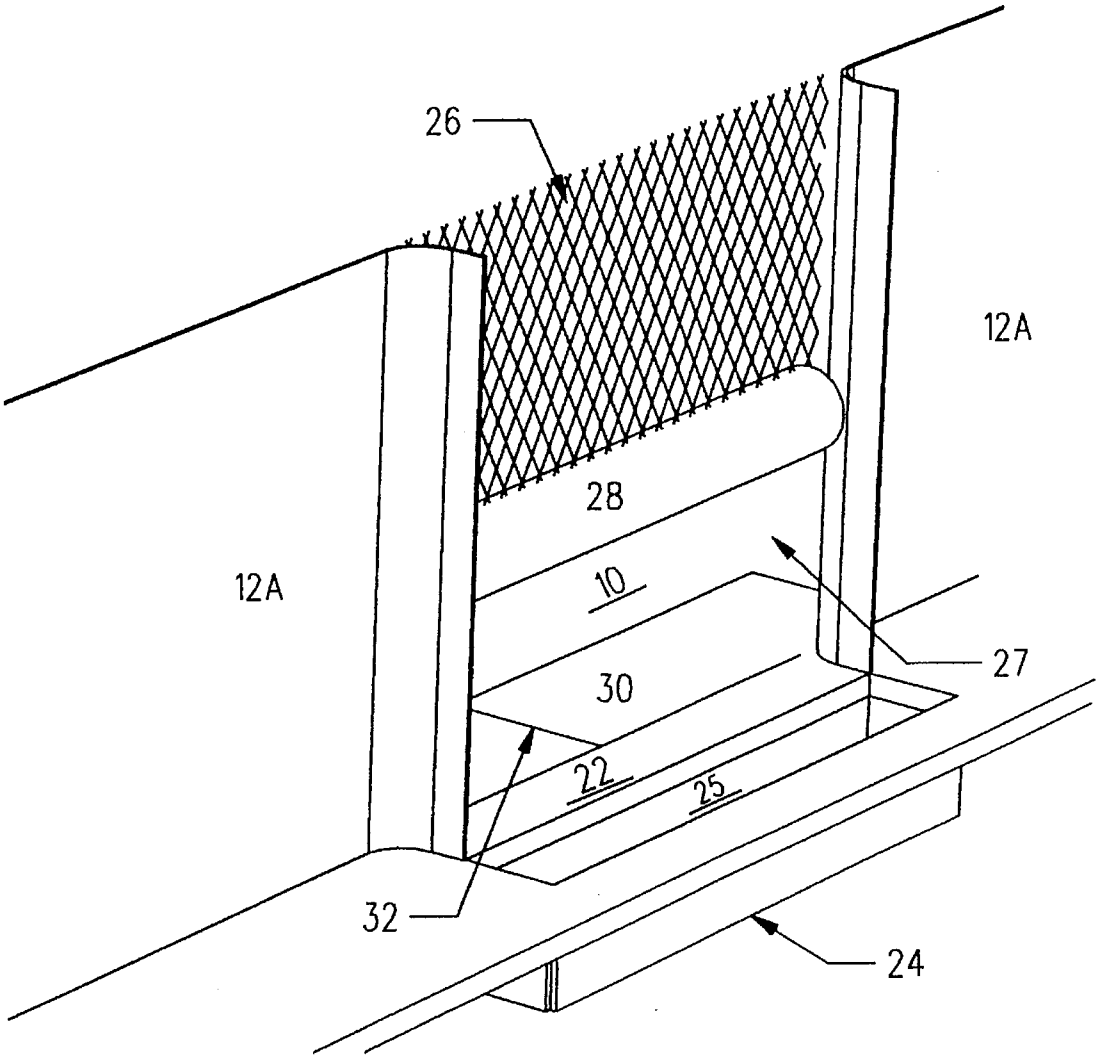
FIG. 3 is a partially elevated rear view of a goal of the present invention.
Figure 4:
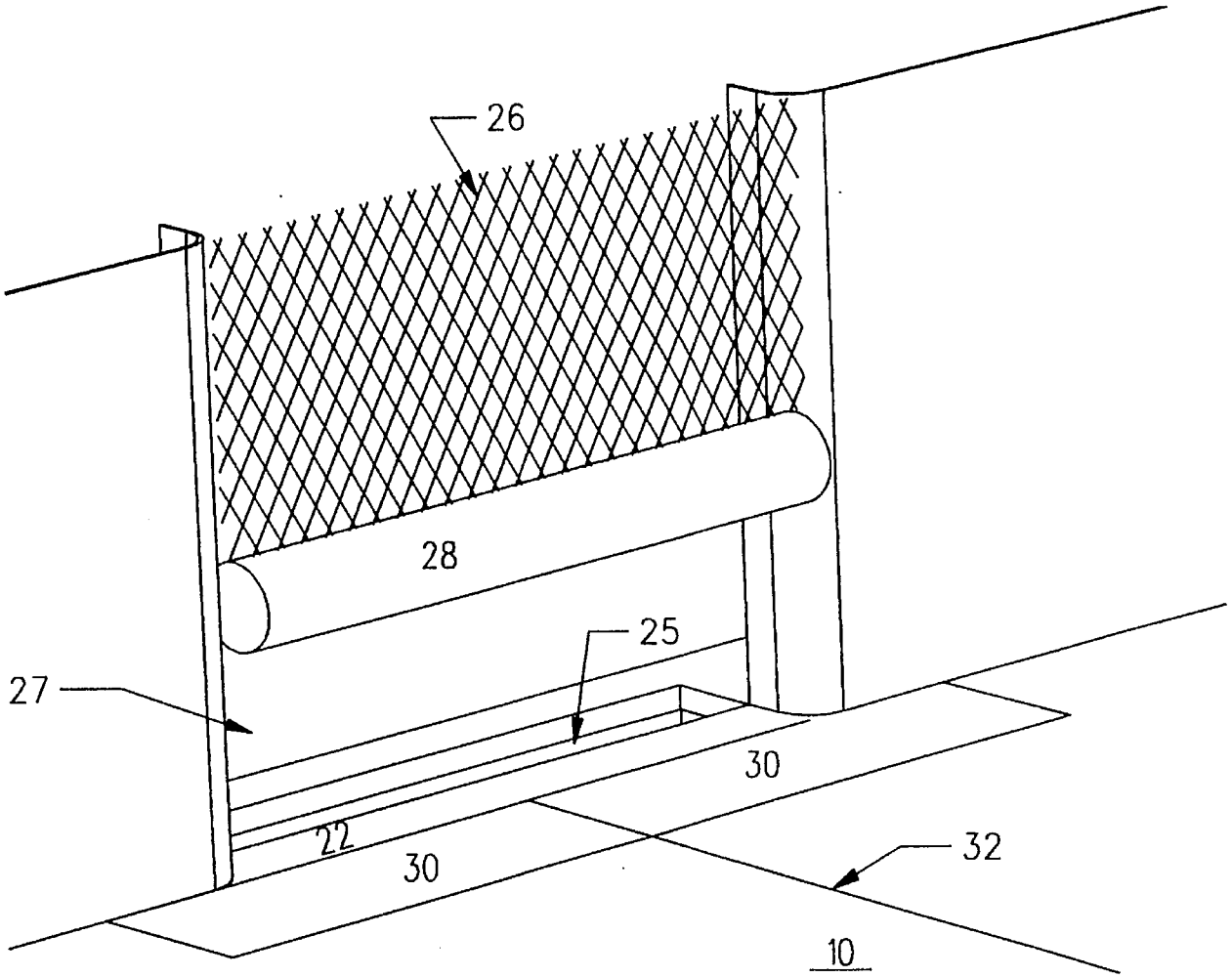
FIG. 4 is a partially elevated front view of a goal of the present invention.

In addition, as shown in greater detail in FIGS. 3 and 4, it is further preferred that the opposed walls 12A or posts defining the length of the goal 20 are rounded and that a portion of the walls 12A extend perpendicular to the end line 15 away from the playing area 10 back to the recess 24. In a preferred embodiment, the rounded corners on the wall 12A have a radius of 6 inches.

An area may be defined about the goal line 22 which comprises a time zone 30. In the preferred embodiment, as discussed more thoroughly herein below, this time zone 30 may comprise a rectangular or box shape. As shown in FIGS. 1 and 2, the time zone 30 may comprise a rectangular box centered about the goal line 22 extending two feet on either side of the goal line 22 and two feet into the playing area 10 from the end line 15. Thus, in the preferred embodiment, the time zone 30 comprises a rectangular box in front of each goal line measuring 2'×12'. The time zone 30 may be marked by lines on the playing surface or the zone itself marked in a color distinct from that of the playing area. Depending on the playing surface, commonly used means of marking a playing area include chalk, paint and dyes.

The playing area 10 may be further divided into quarters with lines extending between the mid-points of the end lines and the mid-points of the side lines. A center line 32 may run from the mid-point of the end lines 15, which will typically also be the center of the goal line 22, to the mid-point of the second end line 15 or opposed goal line 22. Similarly, a mid-field line 34 may extend from the mid-point of the side line 17 to the mid-point of the opposed side line 17. The intersection of the center and mid-field lines 32, 34 will mark the center of the field 36 as well as divide the field into four distinct quarters 10A, 10B, 10C and 10D as shown in FIGS. 1 and 2. About the center of the field 36 may be a center circle 38. In the preferred embodiment, when using a 50'×84' playing area, the center circle 38 or kickoff area may have a radius of 8 feet. As indicated above, these markings may be made by means well known in the art.

A method of playing a game for improving soccer skills shall be discussed with reference to the preferred embodiment of the playing field discussed above. However, it will be noted that the present game may be played utilizing a playing field of different dimension and character than is described in the preferred embodiment. For example, the game could be played without the use of a wall 12 (FIG. 1). In addition, in discussing many of the specific parameters of the method, it will be understood they too may be varied in order to accommodate the particular needs of those practicing the invention. In addition, except as identified herein and where clearly inapplicable, the rules governing the game may be the same as the those governing a traditional soccer match or indoor soccer matches.

The game time preferably comprises two 25 minute halves with a ten minute break therebetween. However, the length of the playing time may be selected and divided as desired. The two teams may comprise three players to a team although these numbers may likewise vary, particularly with considerably younger players or where the size of the field is either increased or decreased from the preferred embodiment.

Each of the two teams will attempt to score in their designated goals while attempting to prevent the opposing team from scoring in the goal they are defending. Thus, referring to FIG. 2, a first team will defend the goal located in the first half 10A, 10B of the field while attempting to score in the goal located in the second half of the field 10C, 10D. In opposition to the first team, the second team will try to score in the goal of the first half 10A, 10B while defending the goal of the second half 10C, 10D. A goal is scored when the ball goes over the goal line 22 and into the recess 24. Due to the nature of the goal, it will be the object of each team to get the ball over the goal line in a sufficiently controlled manner such that the ball goes into the recess. Since the recess opening 25 is parallel with the playing area 10 shots taken from a significant distance, with excessive speed or that are poorly controlled are unlikely to fall into the recess 24. This forces teams to utilize good ball movement and ball control in order to get and take better shots closer to the goal mouth 27.

However, defensive and offensive players may not reach over the goal line 22. If the ball goes into the recess 24 despite a defensive player reaching across the goal line 22, the goal shall stand. In the event a defensive player reaches over the goal line 22 after the ball has crossed the goal line 22 or in an attempt to prevent a goal, and no goal is scored, the offensive team shall be awarded a penalty kick taken at a point 16 feet from the goal line 22.

As used herein the terms "offensive zone" and "defensive zone" are used in their commonly understood meaning; the offensive zone being the half of the field in which the goal a team attempts to score within is located and the defensive zone being the half having the goal within which an opposing team can score a goal. An "offensive player" or "offensive team" refers to a team or player who is in possession of the ball and a "defensive player" or "defensive team" refers to a player or team whose team does not have control of the ball.

Which of the two teams will kickoff or defend a particular side may be selected by any one of various means. One method grants the winner of a coin toss the choice of either kicking the ball into play or selecting a side. For initially placing the ball into play, namely the kickoff, a player from the "kickoff" team may start play by kicking the ball into the opposing team's defensive zone. The person making initial contact with the ball shall not touch the ball a second time until it makes contact with another player, either another member of his or her own team or an opposing player. At kickoff, no opposing player shall be allowed in the center circle and only two players from the kickoff team may be within the center circle. In addition, during kickoff both teams shall be in each of their respective defensive zones.

A goal shall not be awarded to a player kicking the ball from a kickoff directly into the goal unless the ball first touches another player. Thus, the kickoff shall be treated as an "indirect kick". In the event a goal is scored directly on kickoff without the ball touching a second player, the goal is disallowed and the kickoff repeated. At the start of the second half, the teams switch sides and the team that defended the initial kickoff starts the second half with possession and the kickoff.

A player in his or her offensive zone may not remain within the time zone 30 of the opposing team for longer than two seconds. For example, a player defending the 10A, 10B half that stays within the time zone 30 in the 10C, 10D half for over two seconds is considered offsides. An offsides infraction shall result in a free kick at the place of infringement for the non-infringing team. However, prior to taking the kick, the player causing the offsides and one additional player from that same team shall leave their offensive zone until the ball is kicked back into play by the opposing team. A kick from an offsides, unlike the kickoff, would be considered a "direct kick" from which a goal may be scored without contacting another player prior to entering the goal. The common rule governing "offsides" in traditional soccer matches, which generally does not allow an offensive player to be closer to the goal than either the ball or the defensive player furthest in his defensive zone, would preferably be suspended in the present game.

If the ball goes out of bounds over the end lines 15 or over the goal line 22 without a goal being scored, the team defending that goal shall have a goal kick at the point where the ball left the playing area. This is so even if the defending team was the last to contact the ball prior to its going out of bounds. In taking a goal kick, at least two players from the opposing team, that is the team not taking the goal kick, return to their defensive zone for the kick.

When the ball goes out of bounds over a side line 16, a throw-in is awarded against the team that last touched the ball prior to its leaving the playing area. The throw-in is taken at the point at which the ball left the playing area. Prior to a throw-in, two players from the opposing team shall proceed to the quarter of the field furthest from the spot at which the throw-in is taken. For example, if a ball is last touched by a first team prior to going out of bounds over the side line 17 in quarter 10A, two members of the first team must go into quarter 10D, the quarter furthest from the throw-in, until the second team throws the ball bark into play.

An infringement called by the referee shall supersede a throw-in or goal kick. In this regard, infringements may include those defined in traditional soccer matches, examples including handball, dangerous play, high kick, illegal tackle, etc. When a foul is called against a player who engages in rough play the ball shall be placed where the rough play took place and the non-infringing team shall kick the ball into play. A kick awarded because of rough play would be a direct kick. On such an infringement, one of the players of the infringing team shall proceed to the half of the playing area opposite the center line 32 until the ball is kicked into play. Thus, if a player is called for rough play in quarter 10A, prior to the non-infringing team's taking the direct kick a player from the infringing team must go across the center line 32 into either quarters 10B or 10D until the ball is kicked into play.

In addition, in the event of excessively rough play, the player engaging in such play may be made to leave the playing area for a preselected time, such as two minutes, at which time the infringer's team will play one person short. For safety concerns, it is preferable that the infringer not be allowed to return to the field, even when the penalty time has expired, until the referee signals that the player may return.

After placing the ball into play the game proceeds generally in accord with the rules governing a traditional soccer game. However, the ball remains in play off the wall 12 and is considered out of bounds when either going over the wall 12 or over the goal line 22 without entering the recess 24. Due to the unique design of the present game players will gain considerable time handling and passing the ball, thereby improving their individual skills. Moreover, the flow of the present game will continually require players to focus on proper defensive positioning, off-the-ball movement, "touch" or controlled passing, team communication and numerous other skills essential to well rounded soccer players.

It will be understood that various changes may be made to the specifics of the game and apparatus without departing from the spirit of the present invention. It will be well understood by those skilled in the art to make modifications to specific rules, designs and parameters in order to tailor the game to particular needs while still enjoying the benefits of the particular invention. Such modifications are fully intended to be included within the scope of the claims set forth herein below.

What is claimed is:

1. A ball game apparatus comprising:

a playing area substantially defined by two side lines and two end lines, said end lines being longer than said side lines;

at least one goal having a recess of sufficient size to accept a ball, said recess being disposed below said playing area to allow a ball to roll from said playing area and drop therein.

2. The ball game of claim 1 wherein the recess is located outside one of said end lines.

3. The ball game of claim 2 further comprising two goals, each goal located at a distance midway between each of said two side lines.

4. The ball game of claim 3 wherein defined on said playing area is a line extending from the mid-point of one side line to the mid-point of the second side line and a line extending from the mid-point of the first end line to the mid-point of the second end line.

5. The ball game of claim 2 wherein said goal further comprises a goal mouth defined by four sides.

6. The ball game of claim 5 wherein said playing area has a zone defined thereon about said goal line defining an area where no offensive player may be positioned for a defined time period without incurring a penalty.

7. The ball game of claim 3 wherein said goal is positioned adjacent said playing area and defined by a first and second support.

8. The ball game of claim 7 further comprising a barrier extending substantially vertically between said supports.

9. The ball game of claim 8 wherein said barrier is positioned at least 36 inches above said playing area.

10. The ball game of claim 9 wherein at least a lower edge of said barrier is padded.

11. The ball game of claim 8 wherein said barrier is positioned about 36 inches above said goal line.

12. The ball game of claim 6 further comprising a wall extending along the length of said side lines and said end lines.

13. The ball game of claim 12 wherein the portion of said wall interconnecting said end lines and side lines is curved.

14. An apparatus for a ball game, comprising:

a first and second support defining a goal line therebetween;

a barrier extending between said first and second supports wherein the barrier defines an opening above the goal line;

a recess disposed below the goal line to allow a ball to roll over said goal line and drop therein.

15. The apparatus of claim 14 wherein at least a lower portion of said barrier is padded.

16. The apparatus of claim 14 wherein said barrier is positioned about 36 inches above the goal line.

17. The apparatus of claim 14 wherein the recess is about 14 inches wide and about 14 inches deep.

18. The apparatus of claim 14 wherein the opening of said recess is in the same horizontal plane as the goal line.

19. A method of playing a ball game on a playing area between a first and second team wherein said first team defends a first goal and said second team defends a second goal, comprising:

placing a ball in play on said playing area;

kicking the ball within a recess disposed below the playing area to allow a ball to roll from said playing area and drop into said recess thereby scoring a goal;

tallying scores wherein the team with the greatest number of goals at the end of a desired playing period wins said game.

20. The method of claim 19 further comprising awarding a throw-in at the point the ball exits the playing area against the team that was the last to contact the ball prior to its leaving the playing area when said ball goes out of bounds over a side line.

21. The method of claim 20 wherein at least two of the players from the team not taking the throw-in must be in the quarter of the field furthest from where the throw-in is taken prior to throwing the ball back into play.

22. The ball game of claim 19 wherein it shall be a foul to engage in rough play and a player who engages in such play shall leave the game for a selected length of time during which the infringing player's team shall play short handed.

23. The ball game of claim 22 wherein a ball going out of bounds over one of the end lines results in a goal kick for the team defending that end.

24. The ball game of claim 19 wherein a penalty is incurred by a team whose player is within a designated area for a defined period of time, said designated area being positioned near the goal.

25. The ball game of claim 19 wherein a penalty is incurred by a team whose player reaches over a goal line after the ball has crossed the goal line or in an attempt to prevent a goal.

26. The ball game of claim 25 wherein a penalty kick is awarded to the opposing team when a defending player reaches over the goal line after the ball has crossed the goal line.

27. The ball game of claim 19 wherein the playing area is wider than it is long.

* * * * *